US005226855A

United States Patent [19]

Van Lierde

[11] Patent Number: 5,226,855

[45] Date of Patent: Jul. 13, 1993

[54] TOW CHAIN

[75] Inventor: Carlos Van Lierde, Aalst, Belgium

[73] Assignee: Elektriciteit Voor Goederenbehandeling Marine en Industrie, in het kort Egemin, naamloze vennootschap, Schoten, Belgium

[21] Appl. No.: 882,505

[22] Filed: May 13, 1992

[30] Foreign Application Priority Data

May 17, 1991 [BE] Belgium ..... 9100461

[51] Int. Cl.[5] ..... F16G 13/02

[52] U.S. Cl. ..... 474/206; 104/172.2; 104/172.5

[58] Field of Search ..... 474/206, 281; 104/172.1, 172.2, 132.5; 198/833, 838, 851

[56] References Cited

U.S. PATENT DOCUMENTS 3,389,662 6/1968 Jacoby ..... 104/172
3,608,499 9/1971 Krammer ..... 104/172.5
3,662,690 5/1972 Galloway et al. ..... 104/172.5
3,742,863 7/1973 Rosenberger ..... 104/172.2
3,774,545 11/1973 Karlstrom ..... 104/172 C
3,844,221 10/1974 Fromme ..... 104/172 C
4,750,325 6/1988 Messier ..... 474/230 X

FOREIGN PATENT DOCUMENTS 1775740 3/1972 Fed. Rep. of Germany .

*Primary Examiner*—Ramon S. Britts
*Assistant Examiner*—Roger J. Schoeppel
*Attorney, Agent, or Firm*—Foley & Lardner

[57] ABSTRACT

A tow chain consisting of a series of links which are joined together in a hingeable manner by means of vertical shafts. These links have such a towing pattern that the total sum of horizontal widths of the contact surfaces of two successive links of the tow chain are equal to or slightly smaller than the maximum horizontal width of the tow chain.

8 Claims, 3 Drawing Sheets 1
2
3
4
5
6
7
8
9
10
11
12
F2
IV
V
VI 1
2
3
7
8
11
III 1
2
3
4
5
6
7
8
10
11
12

XI
X

TOW CHAIN

FIELD OF THE INVENTION

The present invention concerns a tow chain, in particular a tow chain as is used for transport systems of the type whereby trolleys or such are driven, via a drive pin provided on such trolleys, by a carrier element provided on the tow chain which is drawn in a rail provided in the transport floor.

BACKGROUND OF THE INVENTION

Two different types of such tow chains are mainly used, namely chains whereby the links are joined together in a hingeable manner by means of horizontally placed shafts and chains whereby the links are joined together in a hingeable manner by means of vertically placed shafts, whereby said second type of chains are also provided with rotor wheels placed on the shafts according to a particular embodiment.

The known first type of tow chains has a good bending around a horizontal rotary shaft, but its main disadvantage is that it only allows for a restricted bending around a vertical rotary shaft, due to the required minor play between the horizontal chain shafts and the chain links.

If such a chain of the first type has to undergo a bending in a horizontal plane, an impractically large rotary radius is required in certain cases.

Since these chains usually consist of a number of links with vertical cheeks which are joined together at the top by means of a closing wall, it is clear that the dirt, which accumulates in the rail between the chain cheeks, will be pushed up between these cheeks at a particular moment and will be carried along, one and other such that at the height of a driving gear, bending gear respectively, of such a tow chain, the teeth of such gear will successively press together the dirt in these U-shaped links as a result of which, after a while, on the chain on the one hand and on the gear on the other hand, unwanted forces are exerted which cause the chain to wear out and/or disturb the correct gripping of the teeth of the driving gear in the respective links.

The tow chains of said second type have as a main disadvantage that the bottommost cheeks of half of the links are dragged along the bottom of the above-mentioned rail, which results in a relatively significant wear of the cheeks concerned on the one hand and, after the cheeks have worn out to a certain point, a relatively significant wear of the end concerned of the vertical chain shafts on the other hand.

It is clear that this soon diminishes the strength of the chain.

Another disadvantage of a tow chain of the above-mentioned second type consists in that the dirt which accumulates in the rail in which such chain is moved can only be removed with great difficulty since only the thin side edges of the cheeks of the different links, which are placed side by side, scrape over the bottom of the rail and thus only push the dirt over a limited width such that it is heaped up so to say along the side edges of the chain links.

Yet another disadvantage of this second type of chains consists in that, as the dirt is pushed forward by the above-mentioned cheeks, this dirt is pushed directly against the vertical chain shafts and ends up between these shafts and their bearing, which naturally results in an early wear of these shafts.

In the case where such a second type of chains are provided with rotor wheels placed on the chain shafts, the dirt also ends up between these wheels as a result of the propulsion, which provokes wear on the one hand and causes the wheels to become stuck on the other hand, which provokes even more wear.

SUMMARY OF THE INVENTION

It is therefore the object of the present invention to describe a tow chain which entirely excludes the above-mentioned and other disadvantages of the known chains.

To this aim, the chain of the present invention mainly consists of a series of links which are joined together in a hingeable manner by means of vertical shafts, whereby these links have such a towing pattern that the width of the towing surface, towing surfaces respectively, of one link, increased with the width of the towing surfaces, towing surface respectively, of an adjacent link is equal to or only slightly smaller than the maximum width of the tow chain concerned.

A first advantage of this chain is that, because of its construction, it allows for a smooth and short bending in a horizontal plane.

Another advantage of the chain according to the invention lies in the fact that the dirt which ends up in the rail of such a tow chain is moved along over practically the entire width to a discharge place for dirt. As such, the rail remains relatively clean and wear is restricted. whereby, at the same time the vertical shafts are erected such that they are entirely protected from dirt, such that these shafts do not push along the dirt, which ends up in the rail, in any way such that these shafts are not subject to abnormal wear and the chain is less subject to play and elongation.

Another advantage of the chain according to the invention is that it is self-cleaning since, at the height of the gear drives, the dirt is automatically pushed out of the links concerned.

Another advantage is that the chain according to the invention, in a special embodiment, is made such that the links in the horizontal plane are provided with bent side edges which can cooperate with bending rolls and/or statically bent guides and such.

Another advantage of the chain is that the towing surfaces, which of course also form the wearing surfaces or contact surfaces with the rail, are made and provided such that the chain can be used for a very long time without the links breaking and/or the chain shafts wearing out due to weakening. Indeed, the entire chain according to the invention is calculated without taking into account the additional material to form the towing surfaces, such that the weakening of the actual chain can only occur as such after the additional material has been entirely used up.

Yet another advantage of the chain according to the invention is that the towing surfaces, in particular the additional material of the separate links, are locally hardenable, one and other such that the tenacity of the chain as such is not impaired as a result of the local hardening.

BRIEF DESCRIPTION OF THE DRAWINGS

In order to better explain the characteristics of the chain according to the invention, by way of example only and without being limitative in any way, the following preferred embodiments are described with reference to the accompanying drawings, where.

DETAILED DESCRIPTION OF THE PREFERRED EMBODIMENT

Figure 1:
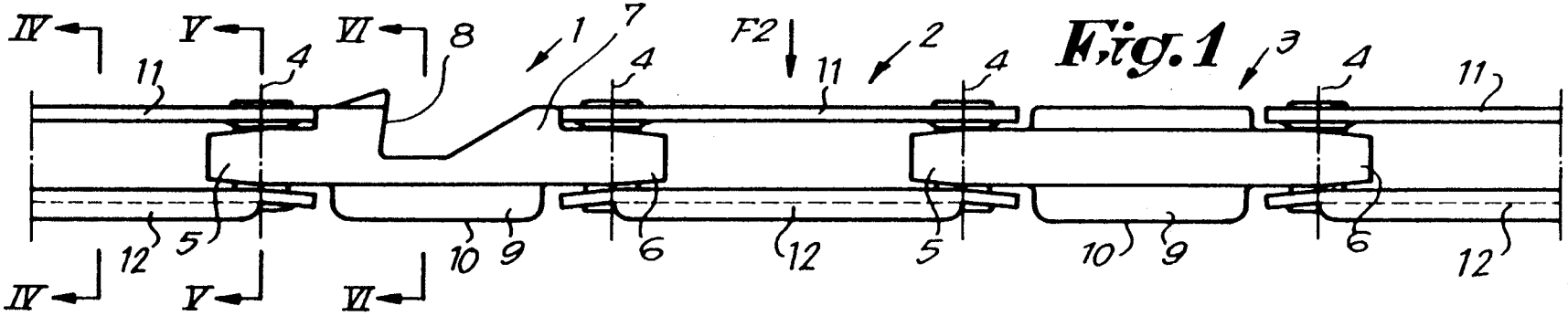
FIG. 1 shows a front view of a tow chain according to the invention.
Figure 2:
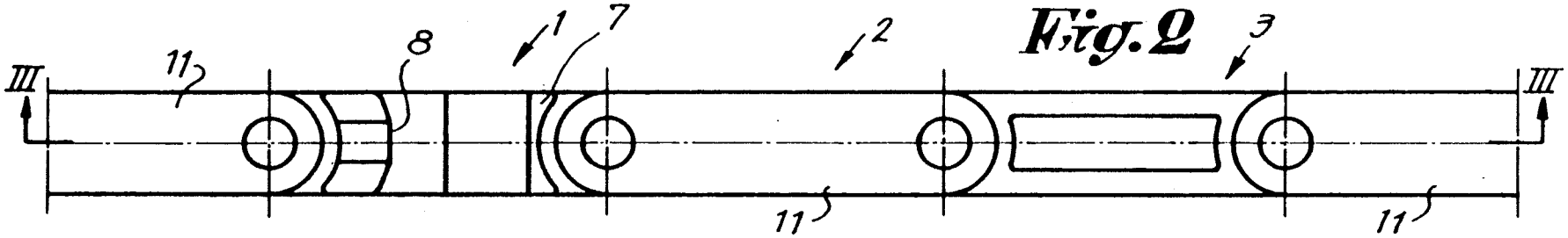
FIG. 2 shows a top view according to the F2 of the chain according to the FIG. 1.
Figure 3:
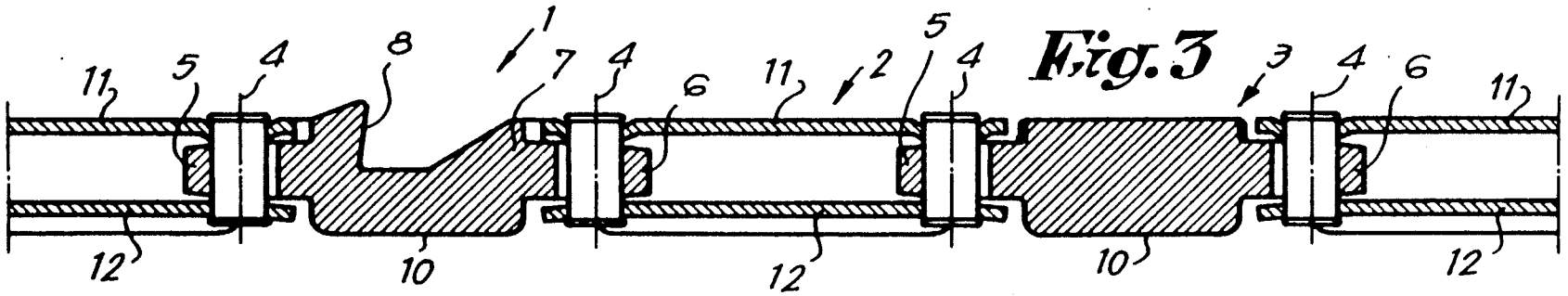
FIG. 3 shows a cross section according to line III—III in FIG. 2.

FIG. 1 shows a tow chain according to the invention which mainly consists of carrier links 1, intermediate links 2 and packing links 3 which are all joined together by means of chain shafts 4 which are placed vertically.

The carrier links 1 have two ends, 5 and 6 respectively, through which the chain shafts 4 concerned are applied. These ends 5 and 6 are joined together by means of a thickened central part 7 on top of which a recess 8 has been made, whereby this recess 8 has an appropriate shape as determined with regard to the drive pin of the trolleys to be transported, and whereby this central part 7 has a protrusion 9 at the bottom with an appropriate length and width which so to say forms the additional material for the towing surface 10 of such chain 1.

The packing links 3, just as the carrier links 1, have ends 5 and 6 with which they have been applied over shafts 4 and, between these shafts 4, at least a downward directed protrusion or additional material 9 with towing surface 10.

The protrusion 9 of a packing link 3 preferably has the same dimensions as a protrusion 9 of a carrier link 1.

The intermediate links 2 consist according to the invention of an upper cheek 11 and a lower cheek 12 which are attached at each end to a common chain shaft 4.

Figures 4, 5, 6, 7, 8, 9, 10, 11:
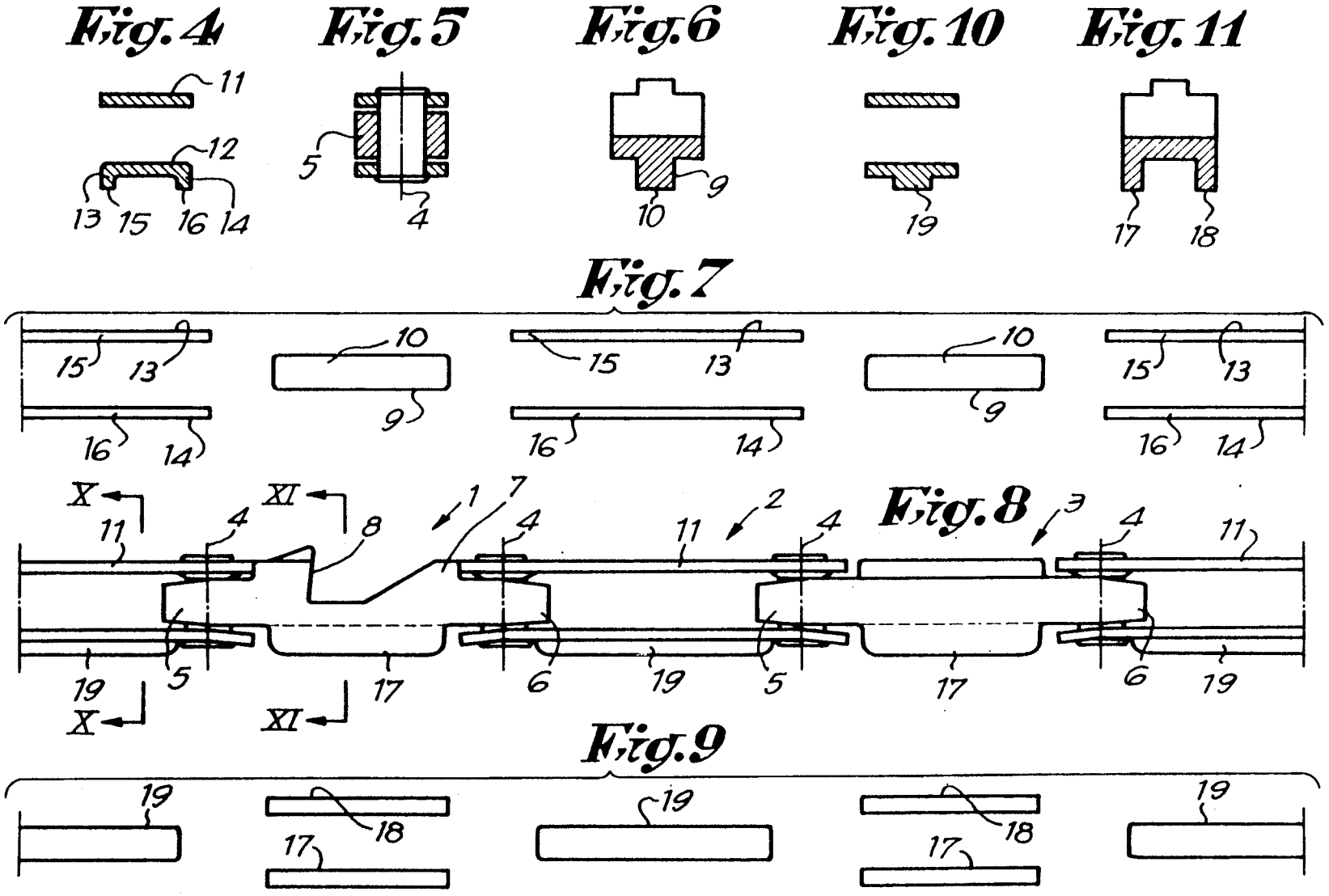
FIGS. 4, 5 and 6 are cross sections according to lines IV—IV, V—V and VI—VI respectively in FIG. 1.
FIG. 7 shows the towing pattern of the chain according to FIG. 1.
FIG. 8 shows a variant of FIG. 1.
FIG. 9 shows the towing pattern of the chain according to FIG. 8.
FIGS. 10 and 11 are cross sections according to lines X—X and XI—XI respectively in FIG. 8.

In this embodiment as illustrated in FIG. 4 the upper cheek 11 is formed by a flat strip of material whereas the lower cheek 12 is formed by a U-shaped profile.

The flanges 13–14 of this U-shaped profile are pointed downward and their lower edge or towing surface 15-16 is placed at a level which corresponds to the level of the lower edge or towing surface 10 of a protrusion 9 of a carrier link 1 and/or a packing link 3, whereas the distance between these flanges 13—14 is practically equal to or slightly bigger than the width of a protrustion 9 of a link 1 or 3.

In the embodiment represented in the drawings these flanges 13 and 14 have been provided on the longitudinal side edges of the lower cheek 12.

In this way, a towing pattern as represented in FIG. 7 is obtained, in other words, whereby the protrusions 9 of the links 1 and 3 on the one hand, and the flanges 13 and 14 of the links 2 on the other hand, are meant to be towed along over an appropriate supporting face as the chain moves.

FIG. 8 shows a variant of the chain according to FIG. 1, whose tagging pattern is represented in FIG. 9 and which is obtained when the links 1 and 3 are provided at the bottom with two protrusions 17 and 18 placed side by side lengthwise, whereas the lower cheek 12 of each intermediate link 2 has been provided with a central protrusion 19.

In this case also, the distance between the protrusions 17 and 18 is practically equal to or only slightly bigger than the width of a protrusion 19.

The total towing surface or contact surface of the protrusions 17 and 18 is preferably equal to the towing surface of a protrusion 9, whereas the towing surface or contact surface of a protrusion 19 is preferably equal to the total towing surface of the protrusions 13 and 14.

Figure 12:
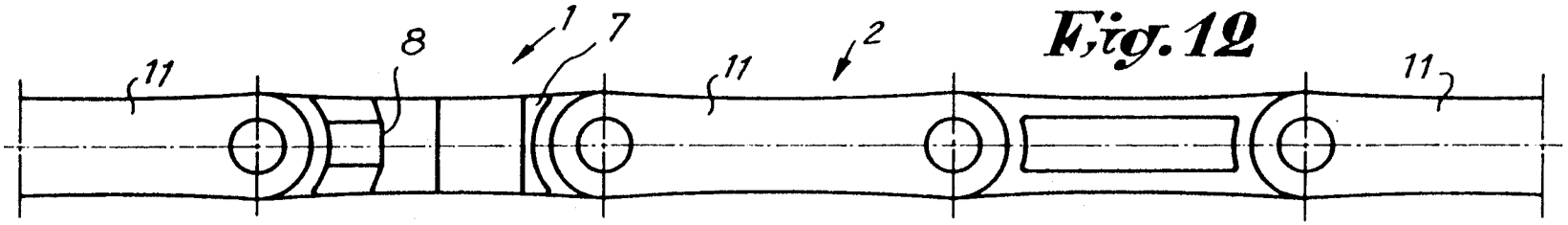
FIG. 12 shows a view similar to that in FIG. 2, but for a variant.

FIG. 12 shows an embodiment whereby the links 1, 2 and 3 have bent side edges such that these links are supported over the entire length on bending rolls and/or statically bent guides.

Figure 13:
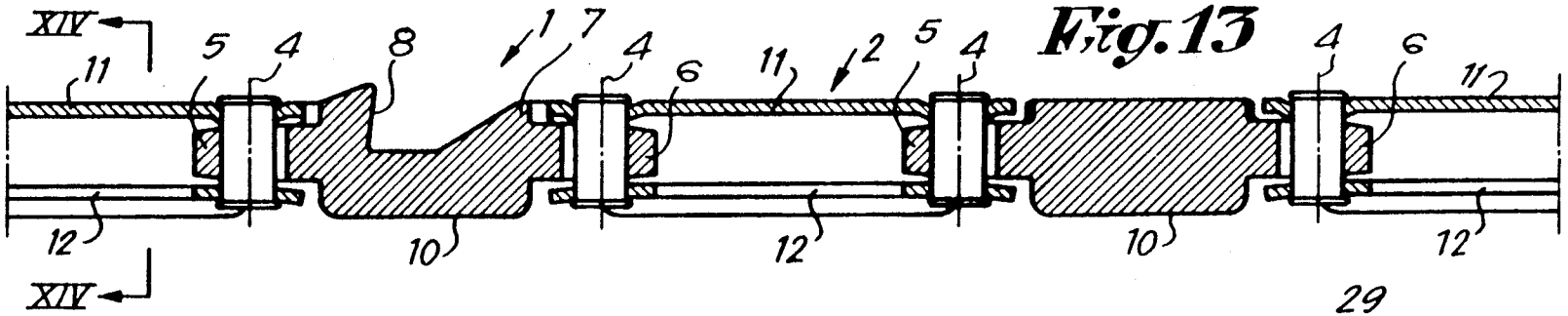
FIG. 13 shows a cross section similar to that in FIG. 3, for a variant.

Finally, FIG. 13 shows an embodiment whereby the body 20 of a lower cheek 12 has an elongated opening 21 through which a possible surplus of dirt between the cheeks 11 and 12 is admitted; afterwards, this dirt is removed from between the cheeks 11 and 12 at the height of a gear drive by the teeth of the gear in question.

Figure 15:
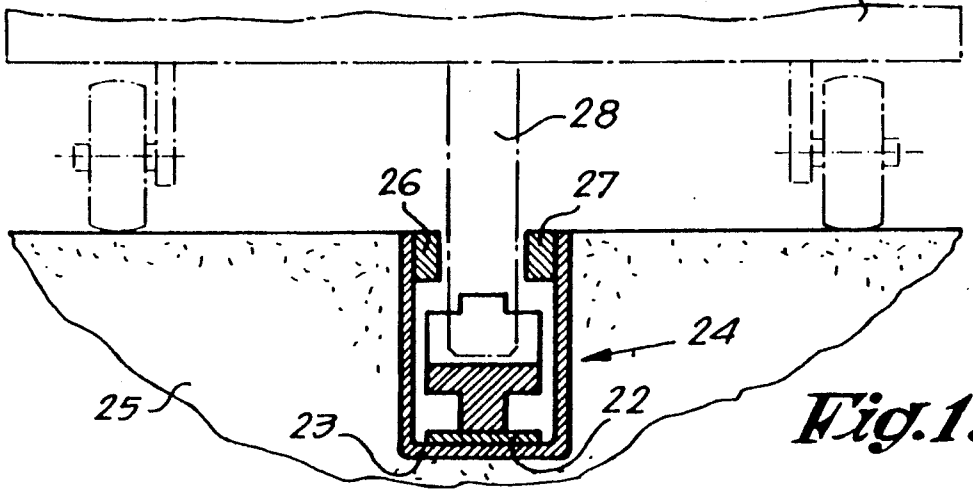
FIG. 15 shows a vertical section through a rail in which a tow chain according to the invention has been applied.
Figure 14:
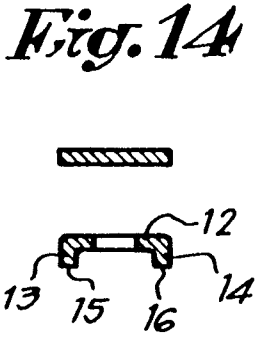
FIG. 14 shows a cross section according to line XIV—XIV in FIG. 13.

Finally, FIG. 15 shows a cross section of a tow chain according to the invention which is pulled along in the known way over a sliding plate 22 which has been applied on the body 23 of a U-shaped rail 24 provided in the floor 25 and whereby such rail 25 has guides 26–27 for the drive pins 28 of trolleys 29.

It is clear that the chain according to the invention, by using vertical shafts, can be bent in a simple and efficient manner around a vertical rotary shaft.

It is also clear that because of the construction and the position of the protrusions 9-13-14, and the protrusions 17-18-19 respectively, a towing pattern is obtained which does not only make it possible for the chain to be properly supported but which also, because of the mutual position of these protrusions, provides for a propulsion of any dirt which possibly ends up in the rail 24 over the entire width of the chain. Thus, as little dirt as possible is left between the sliding plate 22 and the towing surfaces of the protrusions 9-13-14, and the protrusions 17-18-19 respectively.

Further, the drawings clearly show that the dirt which is located in the rail 24, thanks to the presence of a protrusion 9 for an intermediate link 2, remains off the chain shafts 4 such that the wear of these chain shafts is restricted to the normal wear which occurs between such chain shaft 4 and the cheek 11-12 and protrusion 5 or 6 applied to it.

Since the towing and wearing surfaces are formed by the lower cheeks of the protrusions 9-13 and 14 and the lower cheeks of the protrusions 17-18 and 19, which are placed at such a level that only after a relatively significant wear of these protrusions the chain shafts 4 can make contact with the sliding plate 22, a chain is obtained according to the invention which, without a weakening of the actual chain occurring, has a very long service life.

Indeed, the chain is calculated without taking into account the additional material of the protrusions 9-13-14, and 17-18-19 respectively.

In this way it is also possible according to the invention to harden only the protrusions 9-13-14, and 17-18-19 respectively, such that very hard towing surfaces are obtained, whereas at the same time the chain remains tough.

It is clear that the present invention is in no way limited to the embodiments described by way of example and shown in the accompanying drawings. To the contrary, such a chain according to the invention can be made in various forms and dimensions while still remaining within the scope and spirit of the present invention.

I claim:

1. A tow chain comprising:

a series of successive links, each link having at least one bottom contact surface which is supported on a support surface;

vertical shafts for interconnecting said successive links in a hingeable manner; and wherein each of the bottom contact surfaces has a horizontal width, and the total sum of the horizontal widths of the bottom contact surfaces of two successive links of said chain are equal to or slightly smaller than a maximum horizontal width of said tow chain.

2. The tow chain of claim 1, wherein one of two successive links of said tow chain has a single contact surface, and the other of said two successive links has two bottom contact surfaces.

3. The tow chain of claim 1, wherein said successive links each comprise at least one downwardly directed protrusion with a bottom surface, and said contact surfaces of said successive links are formed by said bottom surfaces of said protrusions.

4. The tow chain of claim 2, wherein said successive links are alternately structured such that a first successive link comprises a single downwardly directed protrusion with a bottom surface forming a first contact surface, and a second successive link comprises two downwardly directed protrusions each having a bottom surface thereby forming second and third contact surfaces, wherein a horizontal width of the first contact surface is equal to or slightly smaller than a distance between the second and third contact surfaces of the second link.

5. The tow chain of claim 4, wherein said single protrusion of said first successive link is situated centrally in the longitudinal direction of the tow chain.

6. The tow chain of claim 4, wherein said second successive link has a reverse U-shaped profile with two alternate flanges, said alternate flanges forming said two downwardly directed protrusions.

7. The tow chain of claim 1, wherein said vertical shafts have top and bottom ends, said bottom end being situated at a higher level than the contact surfaces of corresponding successive links.

8. The tow chain of claim 1, wherein each of said successive links further comprise side edges which are inwardly bent.

* * * * *